US005678955A

United States Patent [19]

Chappell

[11] Patent Number: 5,678,955

[45] Date of Patent: Oct. 21, 1997

[54] FLOW MODIFICATION SYSTEM AND METHOD

[76] Inventor: Derrald H. Chappell, 495 Chalk Creek Rd., Coalville, Utah 84017

[21] Appl. No.: 238,451

[22] Filed: May 5, 1994

[51] Int. Cl.[6] ..... F02B 3/00

[52] U.S. Cl. ..... 405/52; 405/15; 405/21; 405/34; 405/80

[58] Field of Search ..... 405/15, 16, 32, 405/34, 21–25, 52, 80

[56] References Cited

U.S. PATENT DOCUMENTS

| | | | |
|---|---|---|---|
| 247,493 | 9/1881 | Gates . | |
| 253,520 | 2/1882 | Du Bois . | |
| 553,662 | 1/1896 | White . | |
| 566,408 | 8/1896 | Neil . | |
| 656,390 | 8/1900 | Condon . | |
| 1,235,021 | 7/1917 | Follmer . | |
| 1,244,623 | 10/1917 | McClees . | |
| 1,852,268 | 4/1932 | Schmidt | 405/15 |
| 2,000,312 | 5/1935 | Wood | 405/34 |
| 2,097,342 | 10/1937 | Rehfeld | 405/34 |
| 2,106,564 | 1/1938 | Fisk et al. | 405/34 |
| 2,162,499 | 6/1939 | Borhek | 405/15 |
| 2,330,017 | 9/1943 | Taylor . | |
| 2,387,965 | 10/1945 | Wood | 405/34 |
| 2,445,545 | 7/1948 | Verner | 256/35 |
| 3,423,072 | 1/1969 | Bernstein | 256/24 |
| 3,815,877 | 6/1974 | Turner | 256/24 |
| 4,073,478 | 2/1978 | Bermudez | 256/27 |
| 4,174,096 | 11/1979 | Campbell | 256/24 |
| 4,279,535 | 7/1981 | Gagliardi et al. | 405/15 |
| 4,422,622 | 12/1983 | Broski, Jr. | 256/25 |
| 4,465,262 | 8/1984 | Itri et al. | 256/24 |
| 4,582,300 | 4/1986 | Chappell | 256/36 |
| 4,711,597 | 12/1987 | Odgaard et al. | 405/15 X |

OTHER PUBLICATIONS

DC Industries Easy Fence, Product Brochure.

*Primary Examiner*—Dennis L. Taylor
*Attorney, Agent, or Firm*—Madson & Metcalf

[57] ABSTRACT

A method and system for modifying the flow of water in a channel includes creating a flow modifier by first obtaining a plurality of rigid substantially linear posts and obtaining at least one brace configured for connection to the posts. The brace is configured with two spaced apart rigid anchor ends, one of which has at least two spaced apart anchor sites. A plurality of rigid cross beams connect the anchor ends, with the cross beams and the anchor ends all substantially coplanar. The method also includes driving at least two of the posts into the channel bed and securely connecting at least one brace to the posts at the anchor sites. An agglomeration matrix may be positioned against the brace for supporting and accumulating materials which amplify the flow modification effect of the brace and matrix. The flow modifier modifies the flow of water by creating a weir, by diverting the flow, by reinforcing the channel bank, by creating a favorable habitat for plant life, or by some combination of these effects.

7 Claims, 6 Drawing Sheets

FLOW MODIFICATION SYSTEM AND METHOD

FIELD OF THE INVENTION

The present invention relates to a system and method for modifying the flow of water in a channel, and more particularly to the placement of steel braces in the channel to create weirs and diverters for reducing erosion caused by the flow.

TECHNICAL BACKGROUND OF THE INVENTION

A channel influences a flow of water in the channel by offering resistance to the flow. As used herein, "flow" denotes a flow of water in a stream, creek, river, lake inlet, pond outlet, or other body of moving water. "Channel" collectively denotes the bed over which the flow moves and the banks between which the flow moves. A channel exists regardless of whether it carries a flow at some particular time. Although many flows are substantially continuous, as in a large river, other flows such as flash floods are intermittent.

The resistance offered to the flow by the channel typically changes over time as the channel erodes. Erosion occurs as the flowing water carries away the sand, soil, and other materials that form the banks and bed of the channel. Erosion is caused by the force of moving water acting against the channel in which the water flows. Over time, erosion alters the shape of the channel. In some cases, the altered channel guides the flow along a substantially different path than the path that was taken before the erosion occurred.

The speed of erosion depends on many factors. For instance, a rocky channel holding a slow-moving stream erodes slowly over the course of many years. The presence of trees and other vegetation along the banks of a channel also slows erosion. On the other hand, severe erosion may occur in the space of a few hours in arid or semi-arid regions which have sparse vegetation and which are subjected to flash floods and high spring run off.

Soil erosion causes serious problems in many locations. As it erodes, the channel may cross property lines, may undercut roads, railways, and buildings, and may threaten telephone and electric power transmission lines. A change in a river's path can also provide the river with new access to flood plains which were previously inaccessible and hence were protected against flooding. Erosion also creates large gullies which are difficult to cross, inhibiting travel even when the gullies do not carry water.

Erosion may be reduced by placing a weir in the channel. A weir resembles a dam in that both obstruct the flow of water. However, a dam blocks substantially all of the water that reaches it, causing the river to overflow its banks directly upstream of the dam and creating a pond or lake. By contrast, a weir slows the flow of water without causing substantial overflow of the banks. The water reaches the weir, is slowed, and then flows over the top of the weir. After passing the weir, water flows downstream with reduced velocity, and erosion is diminished.

Erosion may also be reduced by placing flow diverters in the stream. Flow diverters modify the flow by directing it away from locations that are particularly vulnerable to erosion. Finally, erosion may be reduced by reinforcing vulnerable portions of the channel bank. As used herein, a "flow modifier" modifies the flow of water in a channel by creating a weir, by diverting the flow, by reinforcing the channel bank, or by some combination of these effects.

Several approaches have been taken to reducing the erosion in streams and rivers. In some cases abandoned automobiles have been placed in the channel as flow modifiers to slow the water's velocity and hence reduce erosion. However, such automobiles typically contain oil, gasoline, transmission fluid, foam rubber, and similar environmental contaminants which are potentially harmful to humans and animals downstream of the automobile. In addition, the automobiles are difficult to position with any precision, are too large for use in smaller streams, and are aesthetically unpleasing. Moreover, such use of automobiles is often now unlawful.

Another approach has been to create wooden barricades of various types in a channel. Logs may be thrown across the stream, wooden posts may be driven into the channel bed, or some combination of these approaches may be employed. As a material for modifying fluid flows, wood has both aesthetic and environmental advantages over automobiles. Wood may also be used in smaller channels where automobiles do not fit.

However, erosion is a severe problem in semi-arid and arid regions where trees are scarce, making it costly to haul in logs and dedicate them for use in modifying stream flows. Moreover, wood rots relatively quickly in water, so wooden barricades require continual maintenance and repair. Finally, wooden posts must have a substantial diameter in order to provide sufficient structural strength to withstand the force of even a small river. Streams often have rocky beds. Accordingly, it is often difficult to drive wooden posts of an adequate diameter upright into the channel bed so that the posts can act as supports for the remainder of the barricade.

Attempts have also been made to use fences to control erosion. Typically the fence line runs up to the channel, down through the channel, and continues out the other side. However, wooden posts in fences are difficult to drive into the channel bed, and prone to rot, just like wooden posts in the barricades described above. Moreover, subjecting even a small part of the fence to the impact of rushing water places a much larger section of the fence at risk, because the entire fence is connected. After the flow uproots or knocks over one or more posts, a much larger section of surrounding fence may tilt or even tip over in response to forces transferred from the uprooted part to the surrounding fence.

Another method for modifying stream flow involves placing substantial quantities of rock against the bank being threatened by erosion, or placing even greater quantities of rock within the channel to slow the flow. Unlike wood, rocks are worn away by the water very slowly. Unlike automobiles, rocks have few environmental or aesthetic drawbacks as flow modifiers.

However, it may be difficult to obtain and position rocks which are both small enough to maneuver into the desired position and large enough to remain in that position. Some additional structure is often needed, because the weight of a rock alone is often not sufficient to hold it in the desired position within the flow. Moreover, obtaining a sufficient quantity of rocks and transporting them to the chosen site may be difficult. For instance, if a weir is to be created, a large number of appropriately sized rocks are needed. Otherwise the rocks placed in midstream will simply roll downstream to a bend or an eddy where they finally come to rest well out of the main flow.

Thus, it would be an advancement in the art to provide a system and method for modifying the flow of water in a channel without placing substantial environmental contaminants in the water.

It would also be an advancement in the art to provide such a system and method which are suitable for use in channels of widely varying sizes.

It would be a further advancement to provide such a system and method which do not require driving wooden posts into the channel bed.

It would be an additional advantage to provide such a method and system which support the use of rocks as flow modifiers without requiring large quantities of rock which are chosen from a narrow range of sizes.

Such a flow modification system and method are disclosed and claimed herein.

BRIEF SUMMARY OF THE INVENTION

The present invention provides a method and system for modifying the flow of water in a channel by modifying the resistance offered to the flow. The method includes placing and securing one or more braces in the channel in a manner that alters the resistance offered to the flow by the channel. The braces may be secured in a variety of configurations. For instance, braces may be placed in a path that stretches from one bank of the channel to the opposite bank. The path may be an arcuate path having a convex side facing upstream to better resist the force of the flow.

Alternative embodiments of the present method place the braces along other paths, including a straight path, a path that extends from one bank toward the other bank without reaching it, a mid-channel path that reaches neither bank, and a path that hugs one bank without extending toward the other bank. One alternative secures braces along an upstream path and also along a downstream path to form a terraced weir. Another embodiment forms a diversion by securing a high brace and a low brace in the channel such that the height above the channel bed of at least a portion of the high brace is greater than the height above the channel bed of substantially all of the low brace. According to another embodiment, braces are secured to define a region along the channel bank. By reducing erosion in the region, the braces create a favorable habitat by preventing plants in the region from being uprooted while they struggle to grow adequate root systems.

In one embodiment, the method of the present invention includes the creation of a flow modifier by first obtaining a plurality of rigid substantially linear posts such as conventional steel T-posts used in fencing applications. The embodiment also includes the step of obtaining at least one brace configured for connection to the posts. The braces are configured with two spaced apart rigid anchor ends. Each of the anchor ends has at least one anchor site for connecting the anchor end to one of the posts, and one of the anchor ends has at least two such anchor sites spaced apart from one another. A plurality of rigid cross beams connect the anchor ends, with the cross beams and the anchor ends all substantially coplanar.

In one embodiment of the brace, the anchor ends form the legs of an inverted substantially U-shaped member of the brace, the top of the inverted U forms one of the cross beams, and additional cross beams form an X between the legs of the U. In another embodiment, the top of an inverted U forms one cross beam and another cross beam forms an inverted V between the legs of the U. In a third embodiment of the brace, one of the anchor ends is one leg of an L-shaped member, one of the cross beams is the other leg of the L-shaped member, and a second cross beam spans the separated end points of the L-shaped member's legs to form a triangle. The cross beams and anchor ends in each of these embodiments preferably comprise steel tubes, composites, or plastics, and hence pose minimal risk of releasing environmental contaminants into the water.

In addition to obtaining suitable posts and braces, this embodiment includes the step of driving at least two of the posts into the channel bed. More posts may be driven in larger channels. The embodiment also includes the step of securely connecting at least one brace to two of the posts by connecting at least one anchor site on one anchor end to one of the posts and connecting at least two anchor sites on the other anchor end to a second post. The brace is connected to the posts such that the brace is substantially coplanar with the posts. The total number of braces and posts used depends on the size of the channel, the flow modification desired, and other considerations.

The method optionally includes the further step of positioning an agglomeration matrix against the brace on the upstream side of the brace. The agglomeration matrix modifies the water flow by supporting and accumulating over time an agglomeration of materials which are carried against the matrix by the water in the channel. These materials amplify the flow modification effect of the brace and matrix. A suitable matrix may be formed from wire net, plastic mesh, or other material, but is preferably perforated or otherwise made fluid permeable. The matrix and braces may also be used to hold rocks or other natural materials in place as part of a flow modifier. For instance, the rocks may be placed upstream of the brace against a flap portion of the matrix which extends outwardly from the brace along the channel bed.

These and other features and advantages of the present invention will become more fully apparent through the following description and appended claims taken in conjunction with the accompanying drawings.

BRIEF DESCRIPTION OF THE DRAWINGS

In order that the manner in which the above-recited and other advantages and features of the invention are obtained, a more particular description of the invention summarized above will be rendered by reference to the appended drawings. Understanding that these drawings only provide selected embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
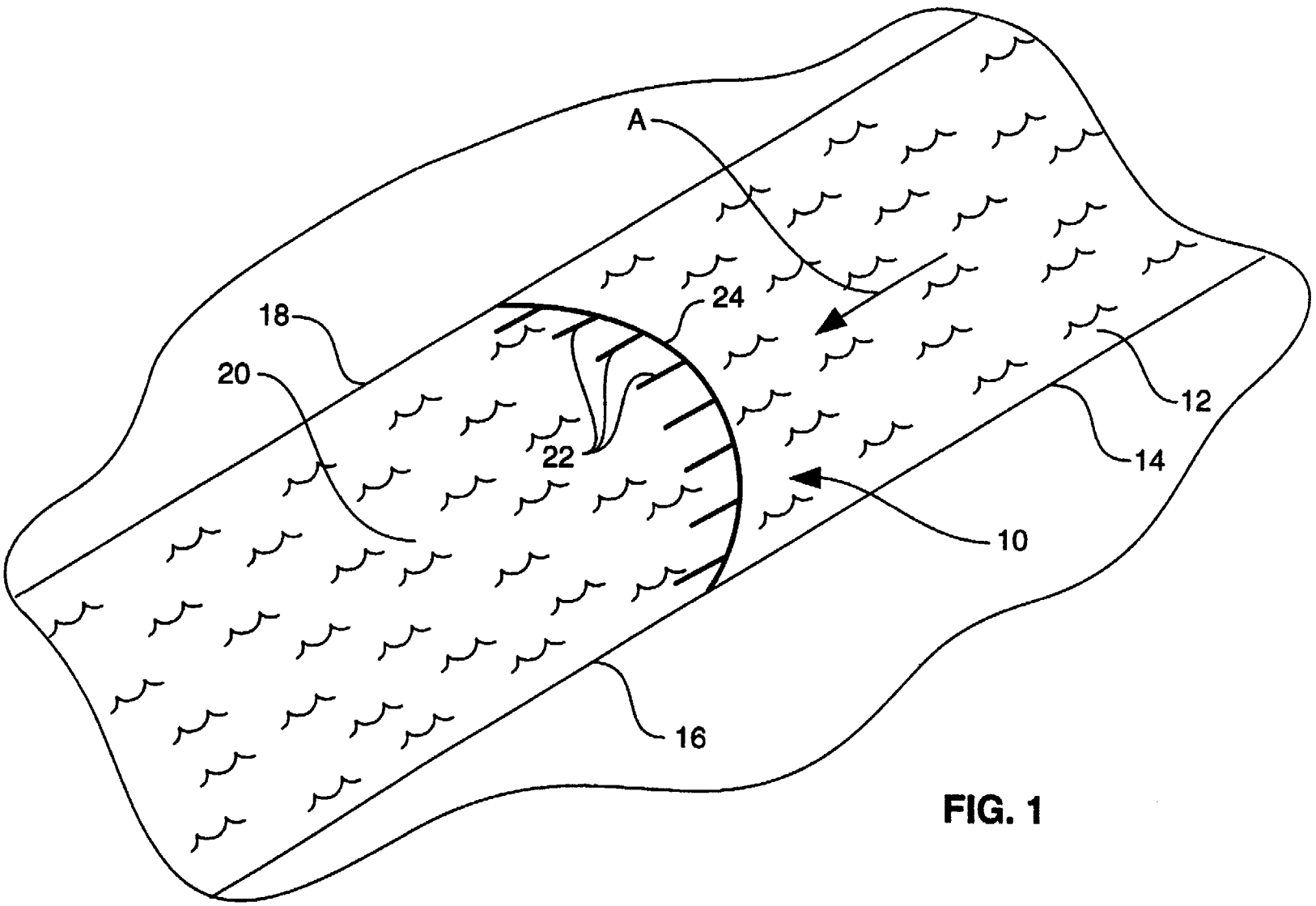
FIG. 1 is a perspective view of a channel in which a system of braces has been assembled according to the present invention for modifying the flow of water in the channel.

Reference is now made to the figures wherein like parts are referred to by like numerals. The present invention includes a system, such as the system designated generally at 10 in FIG. 1, for modifying the flow of water 12 in a channel 14. The present invention also includes a method for modifying the flow of water 12 in the channel 14. The water 12 flows generally from upstream locations toward downstream locations as indicated by Arrow A. The channel 14 includes a first bank 16 and a second bank 18 between which a channel bed 20 stretches.

The channel 14 influences the flow 12 by offering resistance to the flow 12. However, the flow 12 erodes the channel 14 as it flows, thereby altering the resistance offered by the channel 14. The present invention relates to modifying the resistance offered by placing one or more structures in the channel 14. In particular, the present method comprises obtaining at least one brace 22 configured for placement in the channel 14. The method further comprises placing the brace 22 in the channel 14 such that the brace 22 modifies the resistance offered to the flow 12, and securing the brace 22 in position with respect to the channel bed 18.

The braces 22 may be placed and secured in a variety of configurations according to the present invention. FIG. 1 illustrates an embodiment in which a plurality of braces 22 have been placed in the channel and secured in position along a path 24. The path 24 stretches from one bank 16 to the opposite bank 18 of the channel 14. The path 24 is also an arcuate path having a convex side facing upstream to better resist the force of the flow 12.

However, the present method also includes placing braces 22 along many other paths, including but not limited to a straight path, a path that extends from one bank toward the other bank without reaching it, a mid-channel path that reaches neither bank, and a path that hugs one bank without extending toward the other bank. Moreover, a plurality of braces 22 is not required, as the present method also teaches placing and securing a single brace 22.

Figure 2:
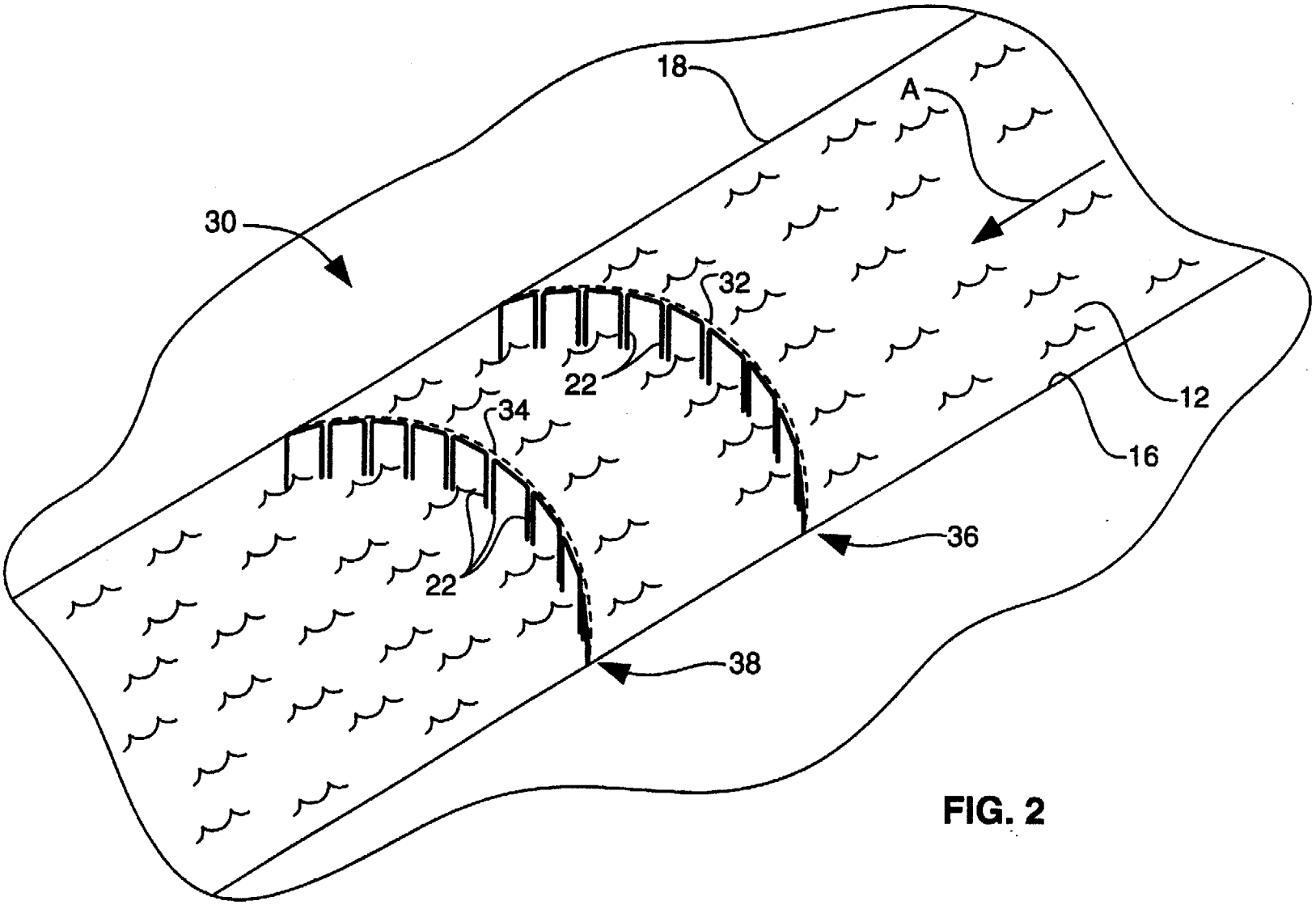
FIG. 2 is a perspective view of a channel in which a terraced weir has been formed according to the present invention.

FIG. 2 illustrates an alternative in which braces 22 are placed and secured to form a terraced weir 30. The braces 22 are placed and secured along an upstream path 32 and also along a downstream path 34. The weir 30 includes an upstream terrace 36 formed with the braces 22 along the upstream path 32 and a downstream terrace 38 formed with the braces 22 along the downstream path 34. Those of skill in the art will appreciate that additional terraces may also be added according to the teachings of the present invention.

Figure 3:
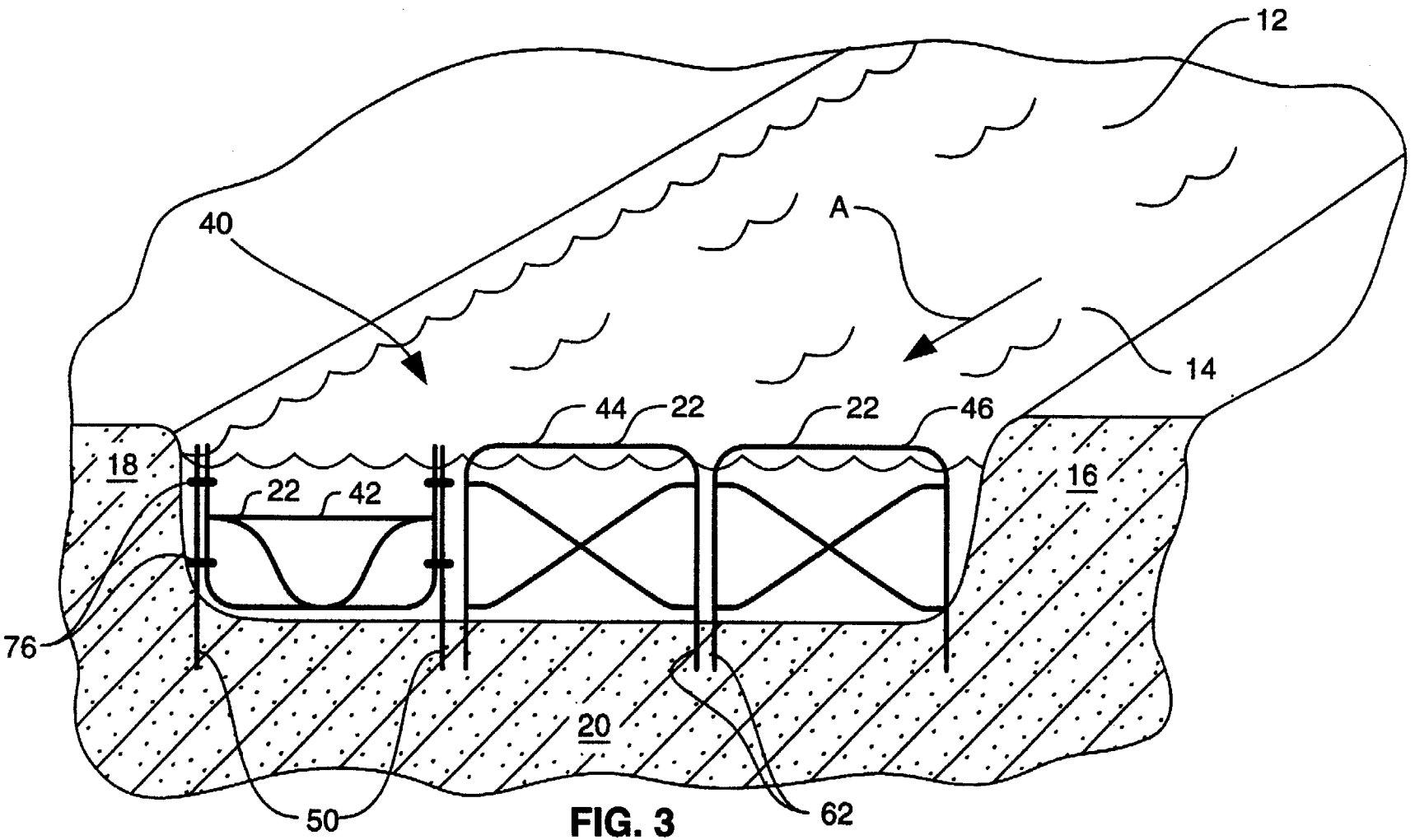
FIG. 3 is a perspective view with a cross section exposed to illustrate the formation of a diversion according to the present invention.

FIG. 3 illustrates an alternative in which braces 22 are placed and secured to form a diversion 40. A low brace 42 is placed in the channel 14 and secured in position relative to the channel bed 20. A high brace 44 is also placed, and is secured in position such that the height above the channel bed 20 of at least a portion of the high brace 44 is greater than the height above the channel bed 20 of substantially all of the low brace 42. Thus configured, the high brace 44 diverts a portion of the flow 12 toward the low brace 42. Additional braces 22, such as an additional high brace 46, may be added to further modify the flow 12.

The present invention also includes braces 22 configured in a variety of other ways. For instance, the brace 42 may be upright rather than inverted as shown in FIG. 3. Moreover, the connectors 76 are employed to connect a plurality of posts 50, a plurality of braces 22, or a combination of one or more posts 50 with one or more braces 22. Thus, the braces 44, 46 which are shown in FIG. 3 secured without posts 50 may be connected to one another with connectors 76.

Figure 4:
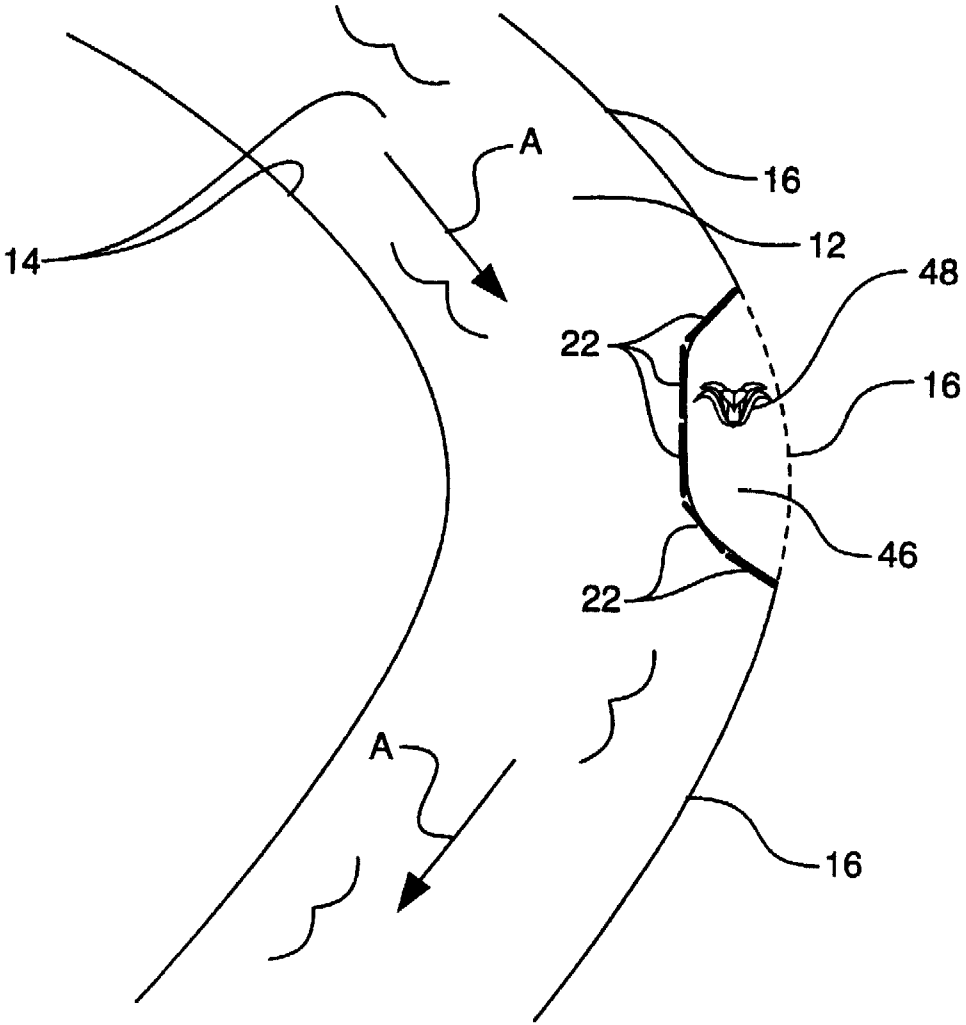
FIG. 4 is a perspective view of a channel in which a region creating a habitat for plant life has been formed according to the present invention.

FIG. 4 illustrates an alternative in which braces 22 are placed and secured such that the braces 22 and the channel bank 16 substantially define a region 46. The braces 22 modify the flow 12 to reduce erosion of the region 46, thereby creating a favorable habitat for the growth of plant life 48 in the region 46. Repeated erosion of a potential habitat interferes with the establishment of plant life root systems. By reducing the erosion of the region 46, the braces 22 provide plants 48 with the time they need to grow adequate root systems.

If the soil originally in the region 46 is inadequate, additional or replacement soil that is more appropriate is placed in the region 46. Trees, bushes, or grasses 48 are then planted or permitted to grow in the region 46. After they are sufficiently established, the root systems of such plant life 48 will reinforce the bank 16 of the channel 14. Once the plant life 48 is well-established, the braces 22 may be removed, and the plants 48 will remain behind as a natural flow modifier in the region 46.

Figure 5:
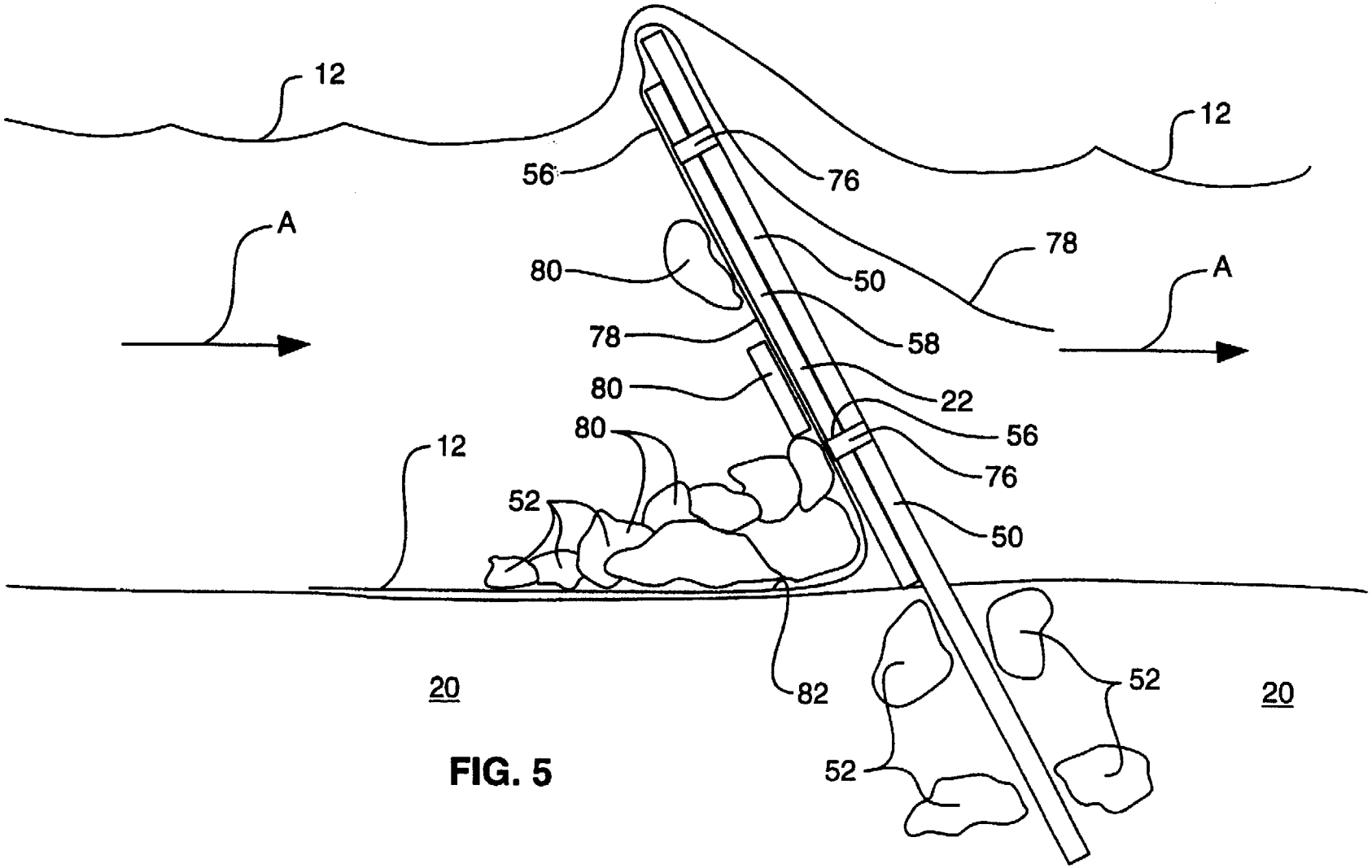
FIG. 5 is a cross sectional view of a post and a brace positioned in a channel to modify the flow.

With reference to FIG. 5, one embodiment of the method of the present invention includes the step of obtaining a plurality of rigid substantially linear posts 50. The posts 50 may be conventional steel T-posts used in fencing applications, pipes, bars, or other rigid and substantially linear members. The diameter of the posts 50 is preferably small enough to facilitate driving the posts 50 into the channel bed 20 past rocks 52.

Figure 6:
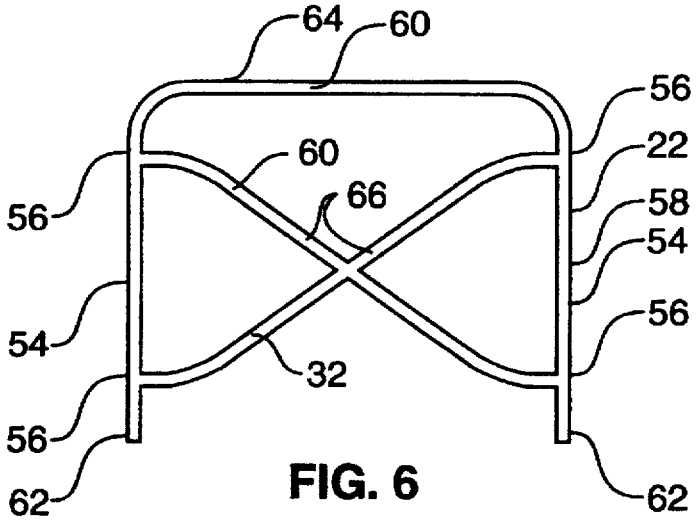
FIG. 6 illustrates an embodiment of the brace which includes an inverted U-shaped member and cross beams forming an X.
Figure 7:
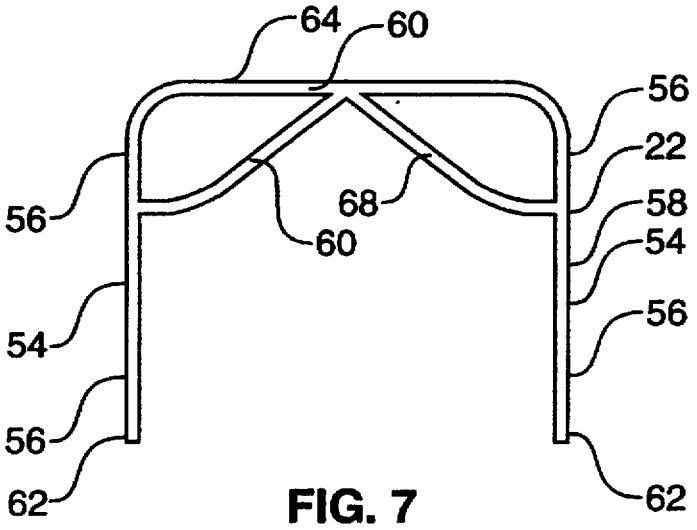
FIG. 7 illustrates an embodiment of the brace which includes an inverted U-shaped member and cross beams forming an inverted V.
Figure 8:
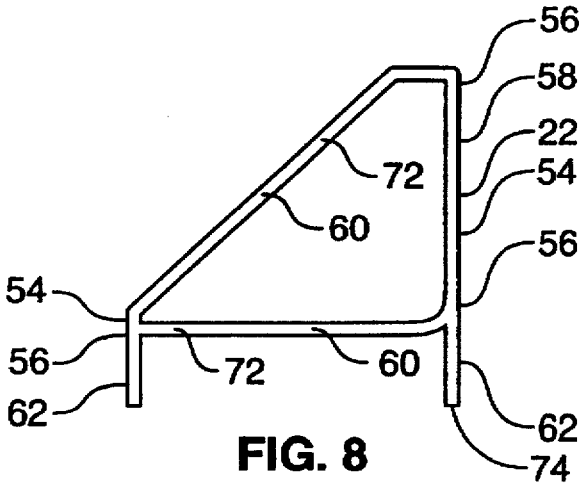
FIG. 8 illustrates an embodiment of the brace which includes an L-shaped member and a cross beam forming a triangle.

The method also includes the step of obtaining at least one brace 22 configured for connection to the posts 50. As illustrated in FIGS. 6 through 8, each brace 22 is configured with two spaced apart rigid anchor ends 54. Each of the anchor ends 54 has at least one anchor site 56 for connecting the anchor end 54 to one of the posts 50 (FIG. 5). One of the anchor ends 58 has at least two such anchor sites 56 spaced apart from one another. Each anchor site 56 is preferably not fixed in place, but may rather be chosen at any convenient location along the anchor end 54. A plurality of rigid cross beams 60 connect the anchor ends 54 and 58. The cross beams 60 and the anchor ends 54 are all substantially coplanar.

As an alternative to connecting the brace 22 to the posts 50 (FIG. 5), the brace 22 may be equipped with feet 62 which are disposed and configured to be driven into the channel bed 20 (FIG. 5). So configured, the brace 22 may be utilized either with or without posts 50 (FIG. 5). Conversely, the brace 22 may be configured without feet 62, so that the use of posts 50 (FIG. 5) is not merely possible but is also required in order to secure the brace 22 in position with respect to the channel bed 20 (FIG. 5).

In embodiments of the brace 22 illustrated in FIGS. 6 and 7, the anchor ends 54 form the legs of an inverted substantially U-shaped member of the brace 22. In the embodiment of FIG. 6, the top 64 of the inverted U forms one of the cross beams 60, and additional cross beams 66 form an X between the legs of the U. In the embodiment illustrated in FIG. 7, the top 64 of the inverted U forms one cross beam, while another cross beam 68 forms an inverted V between the legs of the U.

A third embodiment of the brace 22 is shown in FIG. 8. One of the anchor ends 58 is one leg of an L-shaped member, and one of the cross beams 70 is the other leg of the L-shaped member. A second cross beam 72 spans the separated end points of the L-shaped member's legs to form a triangle. In three other embodiments, the brace 22 includes only the left foot 62, only a right foot 74, and neither of the feet 62, respectively. The embodiments illustrated are provided by way of example only, as many other embodiments of the brace may be used according to the teachings herein. For instance, the anchor ends 54 need not be linear, so long as adequate anchor sites 56 are provided.

The cross beams 60 and anchor ends 54 of the braces 22 should be configured for placement in the flow of water 12. Thus, the cross beams 60 and anchor ends 54 preferably comprise steel tubes, composites, plastics, or another material which has sufficient structural strength to resist the force of the flow of water 12 (FIG. 1). In addition, the braces 22 are preferably formed of such materials which pose little risk of releasing environmental contaminants into the water. In a presently preferred embodiment, the braces 22 are formed of one inch square 16 gauge steel tube, and all joints between cross beams 60 and anchor ends 54 are butt welded. The braces 22 may be partially or entirely coated with water-resistant paint or a similar conventional protective covering.

In addition to obtaining suitable braces 22 and posts 50, as illustrated in FIG. 5, the embodiment includes the step of driving at least two of the posts 50 into the channel bed 20. Although FIG. 5 illustrates a post 50 driven in at a particular angle with respect to the channel bed 20, different applications of the present invention may call for posts 50 to be driven at other angles. All angles, including right, acute, and obtuse angles are contemplated for placement of the posts 50 and braces 22 relative to the channel bed 20 so long as the braces 22 are placed to modify the resistance offered to the flow 12.

As illustrated in FIG. 5, the embodiment employing posts 50 also includes the step of securely connecting at least one brace 22 to two of the posts 50 by connecting at least one anchor site 56 on one anchor end 54 to one of the posts 50 with a connector 76 and connecting at least two anchor sites 56 on the other anchor end 58 to a second post 50 with additional connectors 76. The brace 22 is shown connected to the posts 50 such that the brace 22 is substantially coplanar with the posts 50, but it will be appreciated that the brace 22 may be connected to the posts 50 in other ways. For instance, the brace 22, posts 50, and channel bed 20 may form a triangle. It is presently preferred that the connectors 76 be conventional steel clamps, but cable ties, wires, nylon rope, or other convenient and durable connectors may also be employed.

An alternative embodiment of the method includes the further step of positioning an agglomeration matrix 78 against the brace 22 on the upstream side of the brace 22. The agglomeration matrix 78 modifies the water flow 12 by supporting and accumulating over time an agglomeration of materials 80 which are carried against the matrix 78 by the water 12. The materials 80 may include, for instance, tree branches, vegetation, sand, gravel, and rocks 52. The materials 80 amplify the flow modification effect of the brace 22 and the matrix 78. In a presently preferred embodiment, the matrix 78 includes a section of plastic mesh or wire net, but other durable material which permits the water 12 to continue flowing past or over the brace 22 may also be used. The matrix 78 is preferably fluid permeable by virtue of perforations, orifices, or another means.

The matrix 78 and brace 22 may also be used to hold rocks 52 or other natural materials in place as part of a flow modifier. For instance, rocks 52 may be placed upstream of the brace 22 against a flap portion 82 of the matrix 78 which extends outwardly from the brace 22 along the channel bed 20. Rocks 52 thus placed assist in anchoring the matrix 78 in position relative to the brace 22 and the channel bed 20, and also act to slow or otherwise modify the flow 12.

Illustrations are provided herein of the present invention's usefulness in modifying a flow of water which is flowing in a channel while the braces 22 are placed and secured. However, it will be appreciated by those of skill in the art that the resistance offered to a flow may be modified whether the flow is present or not. Thus, the present invention also includes configuring one or more braces 22 in a channel 14 which does not presently contain a flow 12. For example, braces 22 may be secured across desert gullies that carry water only during occasional cloudbursts, or placed in stream beds downstream of a dam. Similarly, braces 22 may be configured along the banks of a river well above the river's normal level but not above its flood level.

In summary, the present invention provides a system and method for modifying the flow of water 12 in a channel 14 without placing substantial environmental contaminants in the water. Unlike abandoned automobiles, the braces 22, posts 50, and matrices 78 of the present system do not pose a substantial risk of releasing contaminants into a river or stream. The present invention also provides a system and method which are suitable for use in channels of widely varying sizes, because the size of the braces 22, as well as the number of braces 22 and posts 50 employed, may be adapted to channels of many different sizes. Rather than requiring a user to drive wooden posts into the channel bed 20, the present invention teaches the use of relatively small diameter posts 50. Because the posts 50, braces 22, and matrices 78 form a structurally sound basis for flow modifiers, it is not necessary to obtain large quantities of rock chosen from a narrow range of sizes. In addition, the posts 50 and braces 22 may be repositioned or even removed with substantially less effort than flow modifiers constructed solely of rocks or logs.

The invention may be embodied in other specific forms without departing from its spirit or essential characteristics. The described embodiments are to be considered in all respects only as illustrative and not restrictive. Any explanations provided herein of the scientific principles employed in the present invention are illustrative only. The scope of the invention is, therefore, indicated by the appended claims rather than by the foregoing description. All changes which come within the meaning and range of equivalency of the claims are to be embraced within their scope.

What is claimed and desired to be secured by patent is:

1. A flow modification system for modifying the flow of water in a channel, said system comprising:

a plurality of rigid substantially linear posts;

at least one brace configured for assembly with said posts to form said system, said brace comprising:

two spaced apart rigid anchor ends, each of said anchor ends having at least one anchor site for connecting said anchor end to one of said posts, and one of said anchor ends having at least two spaced apart anchor sites;

at least one rigid cross beam connecting said anchor ends, said cross beam and said anchor ends being substantially coplanar; and an agglomeration matrix disposed against said cross beams and configured to modify water flow by supporting and accumulating over time an agglomeration of materials carried against said brace by the water in the channel, a flap portion of said agglomeration matrix extending outwardly at an angle from the plane defined by said cross beams and said anchor ends;

a plurality of connectors securely connecting said brace between two of said posts, one of said connectors connecting said at least one anchor site to one of said posts, at least two other of said connectors connecting said at least two anchor sites to a second said post such that said brace is substantially coplanar with said posts between which said brace is secured.

2. The system of claim 1, wherein the system comprises a plurality of braces, said braces in position along a path stretching from one bank of the channel to the opposite bank of the channel.

3. The system of claim 1, wherein the system comprises a plurality of braces, said braces in position along an arcuate path having a convex side facing upstream to better resist the force of the flow.

4. The system of claim 1, wherein the system comprises a plurality of braces, said braces in position along an upstream path and also along a downstream path, at least a portion of the upstream path being upstream of the downstream path for creating a terraced weir which has an upstream terrace that includes braces along the upstream path and a downstream terrace that includes braces along the downstream path.

5. The system of claim 1, wherein the system comprises a low brace and a high brace, said low brace and high brace positioned and secured within the channel such that the height above the channel bed of at least a portion of the high brace is greater than the height above the channel bed of substantially all of the low brace, for diverting the flow toward the low brace.

6. The system of claim 1, wherein the agglomeration matrix is anchored against the channel bed.

7. The system of claim 1, wherein the agglomeration matrix is positioned against the brace, and wherein the brace is placed and secured to reduce erosion of the channel bank by creating within a region a favorable habitat for the growth of plant life in soil on the opposite side of the brace from the flow.

* * * * *